United States Patent [19]

Pranke et al.

[11] 4,188,561

[45] Feb. 12, 1980

[54] STATION PROTECTOR SPARK GAP APPLIQUE

[75] Inventors: Walter T. Pranke; Manfred W. Wilms, both of Goleta, Calif.

[73] Assignee: Joslyn Mfg. and Supply Co., Chicago, Ill.

[21] Appl. No.: 950,160

[22] Filed: Oct. 10, 1978

Related U.S. Application Data

[63] Continuation of Ser. No. 759,533, Jan. 14, 1977, abandoned.

[51] Int. Cl.[2] ..... H01J 17/00; H01J 21/00

[52] U.S. Cl. ..... 313/325; 313/231.1; 315/36; 361/120; 361/124

[58] Field of Search ..... 361/120, 124, 125, 136; 313/231.1, 325; 315/36

[56] References Cited

U.S. PATENT DOCUMENTS

| | | | |
|---|---|---|---|
| 3,896,343 | 7/1975 | Baker et al. | 313/231.1 |
| 3,947,730 | 3/1976 | DeLuca et al. | 361/124 |
| 4,009,421 | 2/1977 | Splitt et al. | 361/124 |
| 4,034,326 | 7/1977 | Hill et al. | 361/124 |
| 4,051,546 | 9/1977 | Scheithauer | 361/124 |
| 4,056,840 | 11/1977 | Lundsgaard et al. | 361/124 |
| 4,062,054 | 12/1977 | Simokat | 361/120 |

*Primary Examiner*—Saxfield Chatmon, Jr.
*Attorney, Agent, or Firm*—Klarquist, Sparkman, Campbell, Leigh, Hall & Whinston

[57] ABSTRACT

An applique or attachment for a station protector spark gap device includes an insulated enclosure housing a gas tube spark gap device together with fail safe shorting means located circumferentially therearound. Auxiliary gaps in parallel with the gas tube spark gap device are provided as back up should the gas tube vent. Wire leads welded to end plates within the enclosure make connection with the ends of the gas tube spark gap device, the fail safe shorting mechanism and the auxiliary gaps.

39 Claims, 8 Drawing Figures

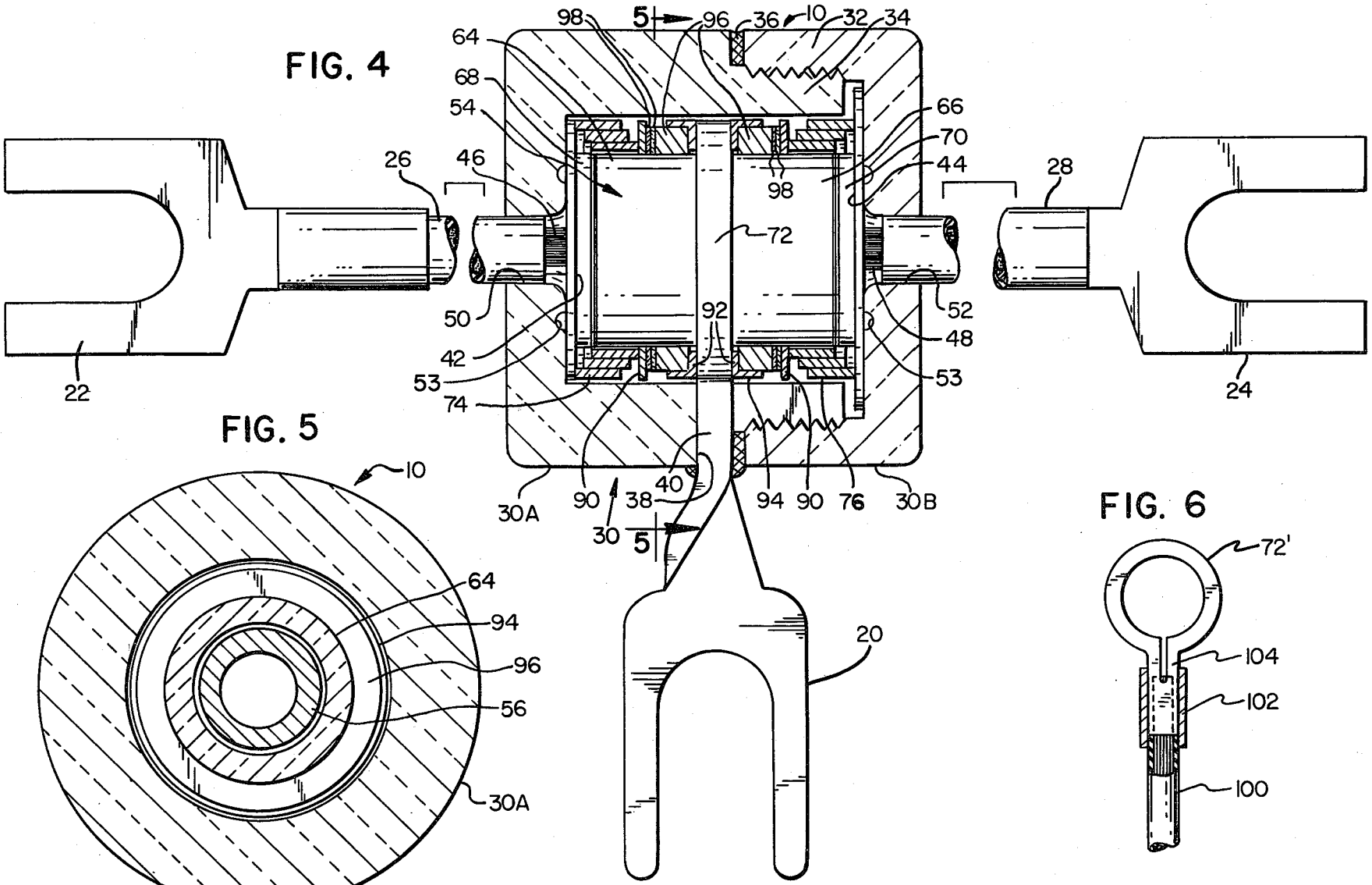
FIG. 4
FIG. 6
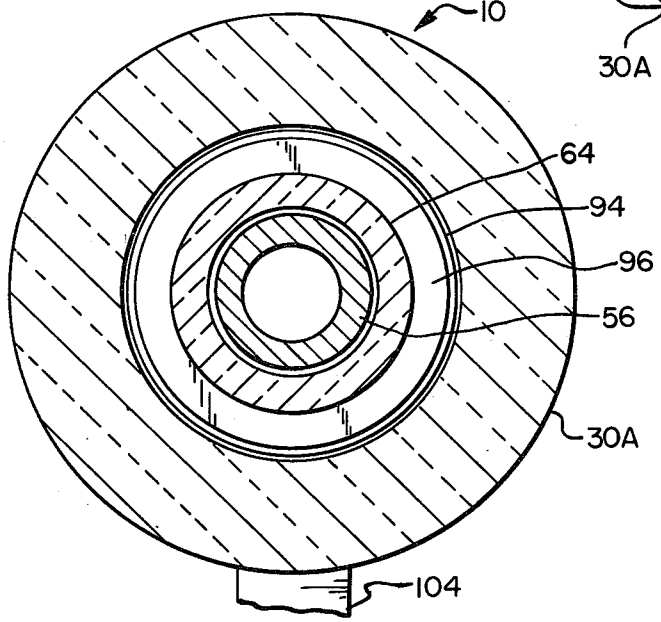
FIG. 5

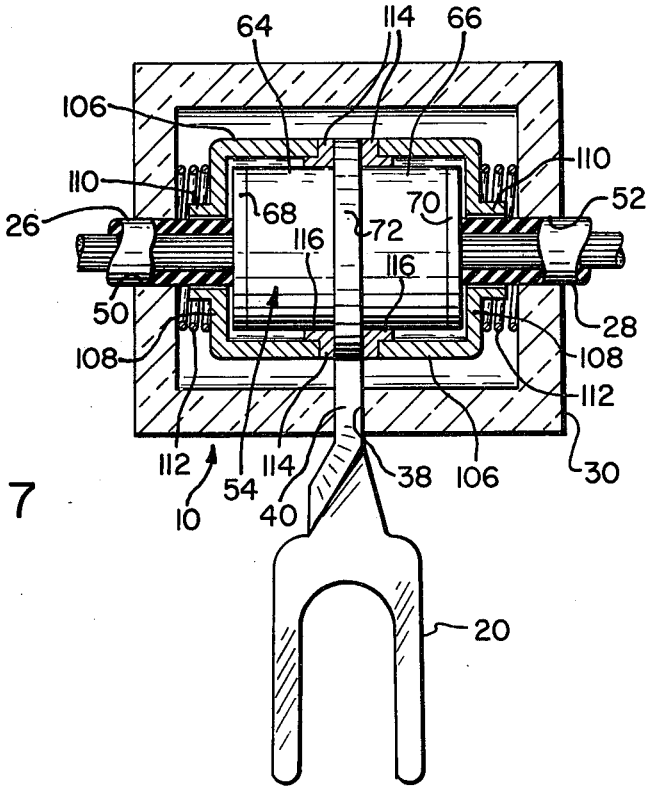
FIG. 7
FIG. 8
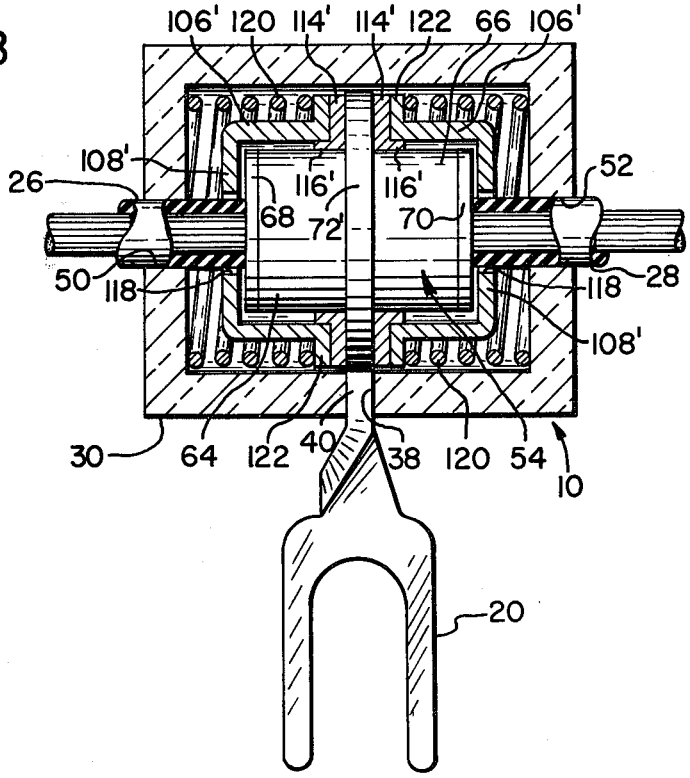

STATION PROTECTOR SPARK GAP APPLIQUE

This is a continuation of application Ser. No. 759,533, filed Jan. 14, 1977, now abandoned.

BACKGROUND OF THE INVENTION

The present invention relates to spark gap devices and particularly to spark gap devices for providing additional protection to existing equipment.

Communication equipment such as a telephone subscriber station is conventionally provided with a spark gap protector for shunting hazardous overvoltage surges to ground. These overvoltage surges can be caused by lightning strokes, power contact of the communication lines with voltage supply lines, power induction, ground potential rise and static buildup. The spark gap device is usually in the form of a station protector which may include carbon block electrodes, and a means for permanently shorting the protector after an extended discharge. While the device is generally effective in the case of overvoltages and excessive currents, the breakdown voltage is not always readily predictable. Moreover, the carbon block electrodes are replaceable and in a given instance may not have been properly replaced, resulting in the loss of electrical protection that is not readily observable from the exterior of the device. Furthermore, carbon dusting and consequently noisy circuits can result from the operation of carbon block gaps. Present add-on devices are the type that fuse open, lift off, and require the carbon blocks as back up protection.

SUMMARY OF THE INVENTION

According to the present invention a spark gap applique or attachment having leads for connection to a station protector is provided for improving the protection afforded by a station protector. Such applique includes an insulated enclosure preferably including connection means substantially unitary with the lead wires for making connection with end terminals of a gas tube spark gap device contained within the enclosure. According to a preferred embodiment, a spring biased, fail safe shorting means is located within said enclosure and is activated by heat for electrically shorting the gas tube spark gap device under predetermined discharge conditions. Auxiliary spark gaps in parallel with the gas tube spark gap device provide protection in the event the gas tube spark gap device vents or opens to the atmosphere, and carbon blocks have been inadvertently omitted from a station protector. Also according to a preferred embodiment, connection means comprise end plates welded to said lead wires and located within the enclosure for making abutting connection with the gas tube spark gap device, the fail safe shorting mechanism and auxiliary gaps within the enclosure.

The applique provides fast, repeatable, balanced response and converts the conventional carbon block station protector to the long-life, trouble-free operation of a gas tube spark gap device. This is accomplished by including a gas tube spark gap device which is designed to operate faster than a carbon block device. The firing voltage, life, response and balance characteristics of the station protector are improved while carbon dusting and consequent noisy circuits resulting from operation of the carbon block gaps are virtually eliminated. The applique is provided with fail safe short circuit features and the end leads thereof terminate in connection means within the applique enclosure which avoid fusing of the leads and open circuiting of the applique. The conventional station protector provides parallel backup protection for the applique if desired.

It is accordingly an object of the present invention to provide an improved overvoltage protection device for connection to communication lines and the like.

It is another object of the present invention to provide an improved spark gap device for upgrading the operation of existing spark gap station protectors.

It is another object of the present invention to provide an improved spark gap device applique or attachment having independent fail safe features.

It is another object of the present invention to provide an improved spark gap device applique having lead wire connections adapted to maintain a complete circuit despite occurrence of heavy surges.

It is another object of the present invention to provide an improved spark gap applique that does not become a fire hazard under an overload condition.

It is another object of the present invention to provide an improved spark gap applique that is compact in design, rugged in construction and economical to manufacture.

It is another object of the present invention to provide an improved spark gap applique that is operative for overvoltage conditions as well as for excessive current conditions.

It is another object of the present invention to provide an improved spark gap applique including a gas tube spark gap device, wherein the applique remains operative in the event of venting of the gas tube spark gap device.

It is another object of the present invention to provide an improved spark gap applique that is sealed against environmental conditions.

It is another object of the present invention to provide an improved spark gap applique for shorting two lines to ground when one line receives an overcurrent surge for an extended time.

It is a further object of the present invention to provide an improved spark gap applique of enclosed construction.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 4 is a longitudinal cross section of a spark gap applique according to a second embodiment of the present invention;

FIG. 5 is a transverse cross section of the FIG. 4 applique taken at 5—5 and FIG. 4;

FIG. 6 is a side view, partially broken away and in cross section, illustrating an alternative grounding connection which may be employed with a device according to the present invention;

FIG. 7 is a longitudinal cross section of a spark gap applique according to another embodiment of the present invention; and FIG. 8 is a longitudinal cross section of a spark gap applique according to still a further embodiment of the present invention.

DETAILED DESCRIPTION

Figure 1:
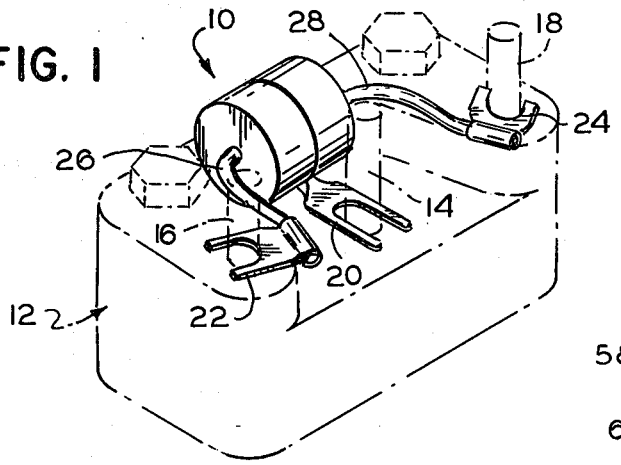
FIG. 1 is a perspective view of a communication line station protector, shown in phantom, together with a spark gap applique/according to the present invention.

Referring to the drawings and particularly to FIG. 1, an applique or attachment 10 according to the present invention is positioned for connection to a conventional station protector 12 as employed, for example, to protect telephone subscriber station equipment from hazardous overvoltage surges. The station protector 12 includes carbon block electrodes (not shown) symmetrically connected with respect to center or ground terminal 14, and line terminals 16 and 18. The applique 10 according to the present invention is provided with a ground lug 20 for engaging terminal 14, and a pair of lugs 22 and 24 connected to the applique by lead wires 26 and 28 and adapted to make connection with terminals 16 and 18 respectively. Lead wires 26 and 28 may comprise number 18 insulated wire and are normally heavier than the other lines connected to station protector 12. The station protector terminals 14, 16 and 18 may comprise threaded rods receiving nuts (not shown) for securing connections to the telephone equipment, drop lines and ground wire as well as to the illustrated applique 10.

Figure 3:
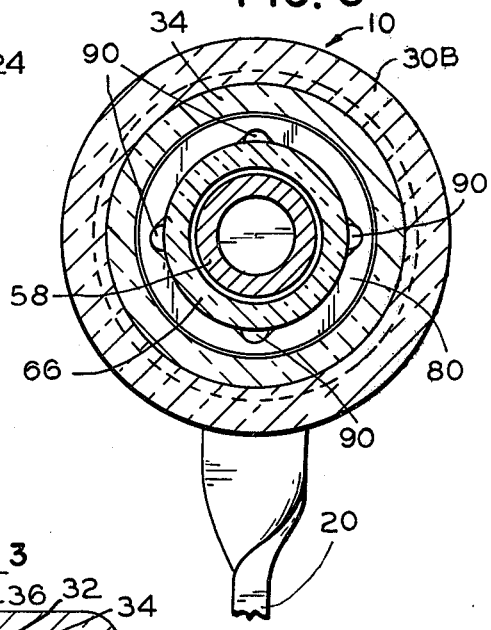
FIG. 3 is a transverse cross section of the FIG. 2 applique taken at 3—3 in FIG. 2.
Figure 2:
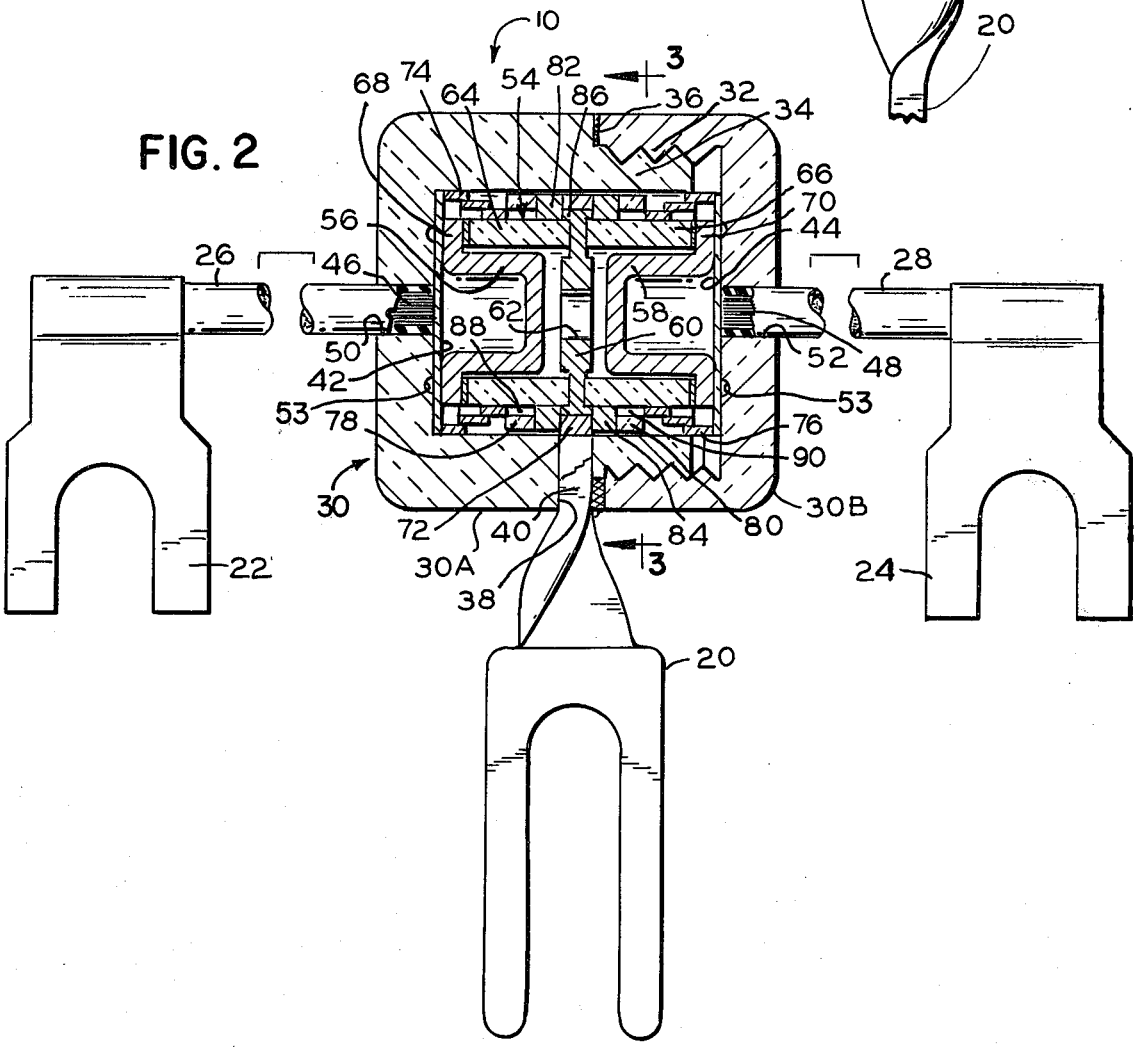
FIG. 2 is a longitudinal cross section of a spark gap applique according to a first embodiment of the present invention.

Referring more particularly to FIGS. 2 and 3, applique 10 according to a first embodiment of the present invention comprises a watertight enclosure 30 including a cylindrical cup 30A externally threaded at 32 to receive a mating internally threaded cup 30B for closing said enclosure. The neck 34 of the cup 30A is of smaller outside diameter where threaded, while retaining the same inside diameter as the major interior portion of the cup. There is therefore provided a shoulder 36 against which threaded cap 30B approximately abuts, and the junction formed at the shoulder is secured with an adhesive sealant material when the applique 10 is completely assembled, such as a mixture of Versamid 140 manufactured by General Mills Chemicals, Inc., 4620 West 77th Street, Minneapolis, Minn., Epon resin 826 manufactured by Shell Polymers Division, 1 Shell Plaza, Houston, Tex., and Cab-O-Sil manufactured by Cabot Corp., 125 High Street, Boston, Mass. Initially, a mixture is prepared of about sixty percent by weight of Versamid 140 resin and forty percent by weight of the Epon 826. To that mixture is added a quantity of Cab-O-Sil, in weight equal to about five percent of the previous mixture. This formulation of sealant material is given by way of example and other potting compounds can be used to seal the device. The cap 30B has a cylindrical wall width substantially matching the width of shoulder 36 and an outside diameter substantially equal to that of cup 30A. Cup 30A also includes the radial groove or passage 38 through which inwardly extending arm 40 of lug 20 passes. This passage 18 is suitably sealed with an adhesive sealant material such as hereinbefore described.

The interior cavity of enclosure 30 is cylindrical and the end walls are substantially flat to receive circular conductive metal end plates 42 and 44 in abutting relation there-against, while the interior conductors 46 and 48 of insulated lead wires 26 and 28 are preferably welded respectively to the center back of the end plates 42 and 44 to form unitary connection means therewith. The end plates 42 and 44 are fairly large, having approximately the same diameter as the inside diameter of the interior cavity of enclosure 30 and are not readily fusible, typically having a thickness of about 0.016 inches. The lead wires 26 and 28 extend through center end apertures 50 and 52 in the enclosure 30. For complete waterproof sealing of the structure, additional sealing material of the type hereinbefore described is applied between the back of the end plates 42 and 44 and the end walls of enclosure 30 surrounding apertures 50 and 52, e.g., in circular grooves 53 provided in the end walls of enclosure 30. The material from which enclosure 30 is formed is insulating and is desirably waterproof and flame retardant. One suitable material is General Electric Valox plastic.

Within enclosure 30 is received a spark gap device 54 of the type described in U.S. Pat. No. 3,811,064 to Chester J. Kawiecki, entitled SPARK-GAP DEVICE, granted May 14, 1974, and assigned to the assignee of the present invention. This spark gap device 54 includes cup-shaped end electrodes 56, 58 and a disc-shaped central electrode 60 provided with an axial aperture 62 and separated from the end electrodes by means of cylindrical insulating spacers 64 and 66 into which electrodes 56 and 58 extend. Electrodes 56 and 58 are spaced from electrode 60 to provide spark gaps therebetween, while aperture 62 enhances simultaneous arcing across the respective gaps. Electrodes 56 and 58 are provided with radial flanges 68 and 70 which comprise end terminals for making abutting connection with end plates 42 and 44 respectively when the enclosure 30 is tightly secured against spark gap device 54 through threading of cap 30B onto cup 30A. The flanges 68 and 70 on their opposed surfaces are also hermetically sealed by means of brazing to the spacers 64 and 66, which are in turn sealed to central electrode 60 for completing an hermetically sealed structure suitably supplied with an internal gaseous environment to complete the gas tube spark gap device 54.

The inwardly extending arm 40 of lug 20 terminates in a conducting metal ring 72 received within the cylindrical interior of enclosure 30, said ring having a rectangular cross section, and having a press fit around the circumference of electrode 60 to provide a secure connection therewith. Ring 72 has the same width in a direction axial of the spark gap device as the outer axial flanged portion 86 of electrode 60. The arm 40 where it joins ring 72 is of rectangular cross section with the larger dimension thereof extending circumferentially of ring 72, said larger dimension being approximately twice as wide as the radial dimension of the ring. At the exit of passage 38, the arm 40 is twisted and flared to provide lug 20. The lug 20 and arm 40 are of heavier construction than the end leads 26 and 28 and the end lugs 22 and 24 because the ground connection generally carries more current and is subject to greater heating during arc breakdown of the spark gap device 54.

The applique 10 also includes fail safe shorting means located therewithin so that after the occurrence of excessive overcurrent conditions, that is, the flow of fault current of a predetermined magnitude and duration, as might otherwise overheat the device 54 and render it ineffective, the device 54 will retain a shorted rather than an open condition. Thus, protection for the associated electrical equipment is maintained and detection and replacement of the faulty device is facilitated. In the applique 10 according to this embodiment, the fail safe shorting means comprises helical springs 74 and 76 disposed in surrounding relation to spark gap device 54 proximate opposite ends of the device 54, insulating rings 78 and 80, and fusible metal rings 82 and 84. The fusible metal rings 82 and 84 abut the sides of ring 72 and flanged portion 86, and the springs 74 and 76 are located next to end plates 42 and 44 for contacting the same. The insulating rings 78 and 80 are disposed between the springs 74 and 76 and the fusible metal rings 82 and 84.

The springs 74 and 76 are suitably formed from flat phosphor bronze strip and are silver plated. The springs are under compression for urging insulating rings 78 and 80 toward fusible metal rings 82 and 84. The insulating rings 78 and 80 are apertured, e.g., around the inside thereof, at 88 and 90, whereby substantial heating of rings 82 and 84 causes flow of the fusible material through apertures 88 and 90 allowing springs 74 and 76 to move insulating rings 78 and 80 toward the center of the device. The fusible material completes a connection between the center electrode 60, and via springs 74 and 76, to the end plates 42 and 44, thus shorting out the applique 10 to a fail safe shorted condition after severe arcing or the like causes the melting of the fusible rings 82 and 84. In addition to making contact with the springs 74 and 76, the fusible material may also flow as far as the end plates 42 and 44. Location of the fusible material next to the central electrode 60 enhances successful operation of the device because of the closer proximity of the fusible material to where heating is likely to be greater due at least in part to greater current flow through central electrode 60, ring 72 and lug 20 to ground during breakdown conditions. Both sides of the device 54 are likely to become shorted when one side receives an overcurrent surge for an extended period. The fusible rings 82 and 84 are suitably formed of a solder type material, while the insulating rings 78 and 80 are suitably formed of a ceramic material or a plastic material of the type from which enclosure 30 is formed.

The applique 10, in addition to suitably being watertight, also has the advantage of the secure attachment of the lead wires 26 and 28 to the end plates 42 and 44 to provide the substantially unitary end connection making contact with each end terminal of the gas tube spark gap device 54. Since the end plates 42 and 44 are relatively large, the construction reduces the possibility of melting or fusing of the lead wires 26 and 28 due to heat generated within the gas tube spark gap device 54 and opening of the protective circuit. Moreover, the present construction confines the flow of fusible metal from rings 82 and 84 to an annular region between the center and ends of the small gas tube spark gap device for assuring fail safe shorted operation rather than dissipating the fusible material elsewhere.

The applique according to a second and preferred embodiment of the present invention includes fail safe shorting means located therewithin as illustrated in FIGS. 4 and 5. In these figures, elements substantially similar to those hereinbefore described and referred to with corresponding reference numerals. Instead of relying upon the flow of fusible metal through apertures in an insulating ring, the embodiment of FIGS. 4 and 5 provides a metal-to-metal connection under fail safe shorted conditions, utilizing a metal contact washer 90 and metal cup washer 92, the latter having an axial flange 94 oriented in the direction of the face of contact washer 90. The radial portion of cup washer 92 abuts the sides of ring 72 and the flanged portion of the central electrode of spark gap device 54, while contact washer 90 is disposed in abutting relation to spring 74 or 76, it being understood that the construction is duplicated on either side of ring 72.

A fusible metal ring 96 and a pair of insulating rings 98 are disposed between cup washer 92 and contact washer 90 for normally spacing the same. Insulating rings 98 are formed of a polyimide resin, for example, to insure against cold flow as might cause premature shorting of the unit. As can be seen, axial flange 94 of cup washer 92 extends along and overlays a portion of fusible metal ring 96, e.g., approximately six tenths of the width of the fusible metal ring 96, while insulating rings 98 adjoin contact washer 90. The insulating rings 98 have an outer diameter less than the inside diameter of axial flange 94, but the outside diameter of contact washer 90 is somewhat greater so that axial flange 94 can come into metal-to-metal contact with washer 90 when fusible metal ring 96 reaches its melting temperature. Again, the fusible metal ring 96, which is suitably formed from a solder type material, is disposed proximate the central electrode of the spark gap device 54 where heating is likely to be greater due at least in part to greater current flow through such central electrode and ring 72 to ground during breakdown conditions.

The applique construction according to FIGS. 4 and 5 also provides auxiliary protection in case of venting of the gas tube spark gap device 54. In case the hermetically sealed spark gap device 54 loses its predetermined internal environment, the breakdown voltage thereof may rise to an undesirably high value determined only by the internal spacing of the electrodes within the gas tube spark gap device 54.

Assuming the applique 10 according to the present invention is connected across the terminals 14, 16 and 18 of a station protector 12 having carbon block electrodes, then the carbon block electrode gap structure will supply desired back-up protection. However, the carbon block devices are replaceable and in a given instance may not have been properly replaced. Furthermore, the applique according to the present invention is desirably usable in applications independent of a conventional station protector.

Referring to FIGS. 4 and 5, auxiliary or backup protection is afforded by the auxiliary gap across insulating rings 98 between washer 90 and fusible metal ring 96. The insulating rings 98 may be chosen in various thicknesses or a single such ring may be employed, whereby protection is secured at various levels according to the spacing of the gap provided thereby. In the absence of a carbon block electrode gap back-up system in a station protector, and in the event the gas tube spark gap device 54 vented to the atmosphere, a high voltage transient exceeding the breakdown voltage of the auxiliary gap would cause sparkover across insulating rings 98 between washer 90 and the fusible metal ring 96. With low current transients, several operations of this auxiliary gap might occur, each causing a reduction is breakdown voltage for subsequent transients until the insulating ring or rings are sufficiently carbonized to establish a short circuit. With sufficient current, this auxiliary gap may short circuit in one operation.

Other than as described above, the construction of the applique 10 illustrated in FIGS. 4 and 5 is substantially the same as the applique illustrated in FIGS. 2 and 3, and is usable either alone for equipment protection or in conjunction with a station protector as illustrated at 12 in FIG. 1.

The springs 74 and 76 are suitably formed from flat phosphor bronze strip and are silver plated, the springs being under compression for urging the contact means 90 and 94 toward one another. However, in the normal condition of the device, insulating rings 98 prevent a short circuit. Then when substantial heating of rings 96 takes place, axial flange 94 contacts the outer side of contact washer 90, completing a connection between the center electrode of spark gap device 54, and via springs 74 and 76 to end plates 42 and 44, thus shorting out the applique 10 to a fail safe condition when severe arcing or the like causes the melting of the fusible rings 96. In addition to causing contact between contact members 90 and 92, the fusible material will also tend to flow around the contact members providing additional circuit paths. In any case, the metal-to-metal connection under spring compression has the advantage of being substantially permanent.

A further embodiment according to the present invention is illustrated in FIG. 7, wherein elements similar to those hereinbefore described are referred to with corresponding reference numerals. This embodiment provides a fail safe shorted connection utilizing cylindrical metal contact cylinders disposed in surrounding relation to the spark gap device 54. In particular, one such cylinder 106 substantially surrounds cylindrical spacer 64 and another such cylinder substantially surrounds spacer 66. Each contact cylinder 106 is provided with an end portion or inwardly extending radial flange 108 disposed in spaced relation to the radial flange or end terminal 68 or 70 of the spark gap device. The spacing is selected to provide an auxiliary gap between the end portion 108 and an end terminal of the spark gap device 54, with the contact cylinder being grounded via fusible metal ring 114 interposed between the remaining or second end of the contact cylinder 106 and the sides of ring 72 adjacent the flanged portion of the central electrode of the spark gap device 54. The fusible metal ring 114 also includes an inner axial flange 116 which separates the contact cylinder 106 from the side of the spark gap device 54 so as to position the contact cylinder 106 centrally.

Each contact cylinder 106 further includes an end collar 110, of smaller diameter, axially receiving a lead wire 26 or 28 therethrough in sliding relation, the said lead wires being welded or otherwise joined to the end electrodes of the spark gap device 54, e.g., within the cup-shaped end electrodes. A spring 112, of larger diameter than the end collar 110, is interposed between an end wall of the enclosure 30 and end portion 108 of the contact cylinder so as to urge each contact cylinder 106 inwardly toward the fusible metal ring 114. When fusible metal ring 114 melts or softens as the result of severe arcing or the like raising the temperature thereof, the spring pressure forces the contact cylinder 106 inwardly causing contact between an end portion 108 and an end terminal 68 or 70. The end terminal 68 or 70 will be grounded to arm 40 via the contact cylinder 106 and the fusible metal ring 114. Since the fusible metal ring, in its non-fused state, determines the normal spacing between end portion 108 and an end terminal 68 or 70, the ring's axial dimension is thus selected to provide such spacing at a value that will supply the desired auxiliary gap protection for the device 54 should the spark gap device 54 vent to the atmosphere.

A further embodiment of the present invention is illustrated in FIG. 8 where, again, elements similar to those hereinbefore described are referred to with corresponding reference numerals. This embodiment is similar to the FIG. 7 embodiment, with the principal difference being the substitution of a larger diameter spring 120 for the smaller spring 112 in FIG. 7. Each spring 120 in the FIG. 8 embodiment is nearly as large in diameter as the cylindrical interior of enclosure 30 and is disposed between an end wall of enclosure 30 and a radial flange 122 at the second end of each contact cylinder 106'. The spring 120 urges the contact cylinder 106' against fusible metal ring 114', which in this embodiment is somewhat larger in diameter to match the flange 122, with the fusible metal ring 114' being interposed between flange 122 and a large diameter metal ring 72. Again, an end portion 108' of each contact cylinder 106' is disposed in spaced relation to an end terminal 68 or 70 of the spark gap device 54 thereby providing an auxiliary gap, with contact being made between such end portion 108' and the end terminal 68 or 70 to short circuit the spark gap device 54 when the fusible metal ring 114' reaches its melting temperature. As in the previous embodiment, inner axial flange 116' centers spark gap device 54. Lead wires 26 and 28 pass through the central apertures 118 in the end walls of the contact cylinders 106'.

In each of the embodiments, a ground lug 20 is joined to a central metal ring 72 by way of a conductive metal arm 40. As an alternative embodiment, the ground lug may be of the same type employed for connection to the line terminals in FIG. 1 and may be connected to a central metal ring 72' via a lead wire 100 as illustrated in FIG. 6. Such lead wire 100 is suitably a number 14 wire inasmuch as the ground connection generally carries more current and is subject to greater heating during arc breakdown of the spark gap device 54'. A lead wire 100 is suitably connected to metal ring 72' by means of a crimped splice connection 102 which grasps the lead wire and firmly connects the same to shank 104 of metal ring 72', such shank having a width approximately twice as wide as the radial dimension of ring 72'. As before, the metal ring 72' has a rectangular cross section and is adapted to make connection with the central electrode in the spark gap device with a press fit around the circumference of such central electrode.

The construction according to the present invention provides numerous advantages under operating conditions. The applique 10 economically converts already installed carbon block protector devices 12 to the long-life, trouble-free operation of gas tubes. The firing voltage, response, life, and balance of the gas tube spark gap device 54 as herein described are more effective than the carbon block devices 12 and dusting and consequent noisy circuits resulting from operation of the carbon gaps are virtually eliminated. The gas tube spark gap device 54 normally shorts moderate as well as severe overvoltages quickly to ground, at a lower voltage level than would be accomplished by the carbon block station protector 12 alone. Of course, the conventional station protector 12 serves as a backup device under severe conditions and is also normally provided with fail safe shorted features. However, the applique 10 itself is a fail safe shorted device so that complete protection can be afforded even if one or both of the carbon blocks are missing from the station protector 12 or where the station protector 12 is otherwise faulty. Fail safe shorted protection occurs with the applique 10 at both sustained low currents (glow mode operation) and high currents without fire hazard.

While the applique according to the present invention is advantageously employed in conjunction with an already existing station protector as herein illustrated, the same applique may be employed as the sole circuit protective device if so desired. Also, even though three element gas tube spark gap devices have been illustrated herein as comprising a principal element of the applique according to the present invention, it is understood a two terminal applique may be provided to include a two electrode gas tube spark gap device, or a three terminal applique may include a pair of two electrode gas tube spark gap devices, connected respectively between lines and ground, instead of a single three electrode gas tube.

While we have shown and described several embodiments of our invention, it will be apparent to those skilled in the art that many changes and modifications may be made without departing from our invention in its broader aspects. We, therefore, intend the appended claims to cover all such changes and modifications as fall within the true spirit and scope of our invention.

We claim:

1. A spark gap protector applique adapted for connecting to a station protector and including lead wires for connection to said station protector, said applique comprising:

a gas tube spark gap device including end terminals, an insulated enclosure for receiving said gas tube spark gap device, said enclosure being provided with connection means which are substantially unitary with said lead wires for making connection with said end terminals of said spark gap device, and a fail safe shorting means located within said enclosure and activated by heat for bringing about shorting of said spark gap device under predetermined discharge conditions, said fail safe shorting means including fusible metal means in heat exchanging relation with said spark gap device and a bias spring and a perforated insulated member located between said spring and said fusible metal means, wherein said spring causes flow of fusible metal through perforations of said insulated member to complete shorting of said spark gap device via said spring when said fusible metal means is fused.

2. The applique according to claim 1 wherein said gas tube spark gap device includes a central electrode separated by insulating means from said end terminals, and wherein said fusible metal means is normally located proximate said central electrode.

3. The applique according to claim 1 wherein said fusible metal means and said insulated member are annular and in surrounding relation to said gas tube spark gap device, said spring helically extending between said connection means and said insulated member.

4. A spark gap protector applique adapted for connection to a station protector and including lead wires for connection to said station protector, said applique comprising:

a gas tube spark gap device including end terminals, an insulated enclosure for receiving said gas tube spark gap device, said enclosure being provided with connection means which are substantially unitary with said lead wires for making connection with end terminals of said spark gap device, and fail safe shorting means located within said enclosure and activated by heat for bringing about shorting of said spark gap device under predetermined discharge conditions, said fail safe shorting means including fusible metal means in heat exchanging relation with said spark gap device and a bias spring and contact means urged toward one another by said bias spring, and insulating means, wherein said insulating means and said fusible metal means normally space said contact means, said spring causing contact between said contact means when said fusible metal means is fused.

5. The applique according to claim 4 wherein said fusible metal means, said insulating means and said contact means are annular and in surrounding relation to said gas tube spark gap device, said spring helically extending between a said connection means and a said contact means.

6. The applique according to claim 1 wherein said enclosure is substantially cylindrical and is comprised of first and second end portions which are threadably joined to complete said enclosure, within which said gas tube spark gap device is received.

7. The applique according to claim 1 wherein said insulated enclosure is substantially waterproof and flame retardant.

8. A spark gap protector applique adapted for connection to a station protector and including lead wires therefor, said applique comprising:

a gas tube spark gap device including end terminals, and an insulated enclosure for receiving said gas tube spark gap device, wherein said enclosure is comprised of first and second end portions which are joined after reception of said spark gap device, said enclosure being provided with connection means welded to said lead wires, said connection means comprising an end plate housed within each end portion of said enclosure for making abutting contact by pressure directly against end terminals of said gas tube spark gap device as said end portions are joined.

9. The applique according to claim 8 further including fail safe shorting means within said enclosure beside said gas tube spark gap device for shorting said spark gap device.

10. The applique according to claim 9 wherein said fail safe shorting means comprises a spring helically enclosing a portion of said gas tube spark gap device, an annular fusible metal body in surrounding relation to said gas tube spark gap device, and a perforated annular insulating member between said spring and said fusible metal body, wherein said spring urges said insulating member toward said fusible metal body to force fusible metal through perforations of said insulating member for making contact with said spring and completing a circuit therethrough to a said end plate when said fusible metal body reaches a predetermined temperature.

11. The applique according to claim 9 wherein said fail safe shorting means comprises a spring helically enclosing a portion of said gas tube spark gap device, a pair of contact means respectively in circuit relation with said spark gap device and urged toward one another by said spring, and an annular fusible metal body and an annular insulating member in surrounding relation to said spark gap device and normally spacing said contact means in non-connecting relation, wherein said spring urges said contact means together into connecting relationship for completing a short circuit of said spark gap device when said fusible metal body reaches a predetermined temperature.

12. The applique according to claim 11 wherein said contact means comprise a contact washer and a cup washer, the latter having an axial flange oriented toward said contact washer for making a connection with said contact washer when said fusible metal body reaches said predetermined temperature.

13. The applique according to claim 9 wherein said enclosure comprises two portions which mate threadably for receiving and enclosing said gas tube spark gap device therewithin.

14. The applique according to claim 9 wherein said gas tube spark gap device includes a central electrode, the applique further including a central lug extending through said enclosure and making contact with said central electrode.

15. A spark gap protector applique adapted for connection to a station protector and including lead wires for connection to said station protector, said applique comprising:

a gas tube spark gap device including terminals, an insulated enclosure for receiving said gas tube spark gap device, said lead wires making connection with terminals of said spark gap device, and fail safe shorting means within such enclosure and activated by heat for bringing about shorting of terminals of said spark gap device under predetermined discharge conditions, said shorting means comprising a spring helically enclosing a portion of said gas tube spark gap device, an annular fusible metal body in surrounding relation to said gas tube spark gap device, and a perforated annular insulating member between said spring and said fusible metal body, wherein said spring urges said insulating member toward said fusible metal body to force fusible metal through perforations of said insulating member for completing a circuit therethrough when said fusible metal body reaches a predetermined temperature.

16. The applique according to claim 15 wherein said insulated enclosure is substantially waterproof and flame retardant.

17. The applique according to claim 15 wherein said gas tube spark gap device includes a central electrode, said fail safe shorting means being duplicated on each side of said central electrode within said insulated enclosure, with the fusible metal bodies being proximate said central electrode on each side thereof.

18. A spark gap protector applique adapted for connection to a station protector and including lead wires for connection to said station protector, said applique comprising:

a gas tube spark gap device including terminals, an insulated enclosure for receiving said gas tube spark gap device, said lead wires making connection with terminals of said spark gap device, and a fail safe shorting means within said enclosure and activated by heat for bringing about shorting of terminals of said spark gap device under predetermined discharge conditions, said shorting means comprising a spring, contact means in circuit with terminals of said spark gap device and urged toward short circuit relation by said spring, and an insulating means and a fusible metal body normally positioning said contact means in non-connecting relation, said insulating means and said fusible metal body being located between and normally spacing said contact means, wherein said spring forces said contact means into connecting relationship when said fusible metal body reaches a predetermined temperature.

19. A spark gap protector applique adapted for connection to a station protector and including lead wires for connection to said station protector, said applique comprising:

a gas tube spark gap device including terminals, an insulated enclosure for receiving said gas tube spark gap device, said lead wires making connection with terminals of said spark gap device, and a fail safe shorting means within said enclosure and activated by heat for bringing about shorting of terminals of said spark gap device under predetermined discharge conditions, said shorting means comprising a spring, contact means in circuit with terminals of said spark gap device and urged toward short circuit relation by said spring, and a fusible metal body normally positioning said contact means in non-connecting relation, wherein said spring forces said contact means into connecting relationship when said fusible metal body reaches a predetermined temperature, and wherein said contact means is cylindrical and disposed in surrounding relation to said spark gap device, said contact means including an end portion normally spaced longitudinally away from an end terminal of said spark gap device, the remaining end of said contact means abutting said fusible metal body adjacent said spark gap device and being urged toward said fusible metal body by said spring so that when said fusible metal body is fused, said spring causes said end portion to make connection with said end terminal of said spark gap device.

20. The applique according to claim 19 wherein said end portion is spaced from said end terminal of said spark gap device by a spacing to provide an auxiliary gap.

21. The applique according to claim 18 wherein said gas tube spark gap device includes a central electrode, said fail safe shorting means being duplicated on each side of said central electrode within said insulated enclosure, with the fusible metal bodies being proximate said central electrode on each side thereof.

22. The applique according to claim 18 wherein said insulated enclosure is substantially waterproof and flame retardant.

23. The applique according to claim 17 wherein said insulated enclosure is substantially waterproof and flame retardant.

24. The applique according to claim 4 wherein said gas tube spark gas device includes a central electrode separated by insulating means from said end terminals, and wherein said fusible metal means is normally located proximate said central electrode.

25. The applique according to claim 4 wherein said enclosure is substantially cylindrical and is comprised of first and second end portions which are threadably joined to complete said enclosure, within which said gas tube spark gap device is received.

26. The applique according to claim 4 wherein said insulated enclosure is substantially waterproof and flame retardant.

27. The applique according to claim 4 wherein said insulating means comprises a thin insulating member having a thickness to provide a spacing for an auxiliary gap across said spark gap device.

28. The applique according to claim 11 wherein said insulating member comprises a thin member of insulating material having a thickness to provide a spacing for an auxiliary gap across said spark gap device.

29. The applique according to claim 8 including an auxiliary gap across said spark gap device for providing protection in the event of improper operation of said spark gap device.

30. The applique according to claim 19 wherein said gas tube spark gap device includes a central electrode, said fail safe shorting means being duplicated on each side of said central electrode within said insulated enclosure, with the fusible metal bodies being proximate said central electrode on each side thereof.

31. The applique according to claim 19 wherein said insulated enclosure is substantially waterproof and flame retardant.

32. The applique according to claim 18 wherein said insulating means comprises a thin body of insulating material having a thickness to provide a spacing for an auxiliary gap across said gas tube spark gap device.

33. A spark gap protector applique adapted for connection to a station protector and including lead wires for connection to said station protector, said applique comprising:

a gas tube spark gap device including terminals, an insulated enclosure for receiving said gas tube spark gap device, said lead wires making connection with terminals of said spark gap device, and a fail safe shorting means within said enclosure and activated by heat for bringing about shorting of said terminals under a predetermined discharge condition, said shorting means comprising a spring, a pair of contact means in circuit with said spark gap device and urged toward short circuit relation by said spring, and a fusible metal body and an insulating member located between and normally spacing said contact means in non-connecting relation, wherein said spring forces said contact means together into connecting relationship when said fusible metal body reaches a predetermined temperature.

34. The applique according to claim 33 wherein said spring helically encloses a portion of said gas tube spark gap device, and wherein said contact means and said fusible metal body are annular and are also disposed in surrounding relation to said spark gap device.

35. The applique according to claim 34 wherein said insulating means comprises a thin washer of insulating material having a thickness to provide a spacing for an auxiliary gap between a said contact means and said fusible metal body.

36. The applique according to claim 34 wherein said contact means comprise a contact washer and a cup washer in surrounding relation to said gas tube spark gap device, said cup washer having an axial flange oriented toward said contact washer for making a connection with said contact washer when said fusible metal body reaches said predetermined temperature.

37. The applique according to claim 36 wherein said fusible metal means and said insulating means are located between said contact washer and said cup washer, said insulating means being within the radius of said axial flange of said cup washer for permitting passage of said flange toward said contact washer when said fusible metal body reaches said predetermined temperature.

38. The applique according to claim 33 wherein said gas tube spark gap device includes a central electrode separated from end electrodes of said spark gap device by insulating means, and wherein said fusible metal body is located proximate said central electrode.

39. The applique according to claim 33 wherein said gas tube spark gap device includes a central electrode, said fail safe shorting means being duplicated on each side of said central electrode within said insulated enclosure, with the fusible metal bodies being proximate said central electrode on each side thereof.

* * * * *